United States Patent [19]

Boucher

[11] 4,216,963

[45] Aug. 12, 1980

[54] PLAYER CONTROLLED TILTING GAME HAVING AN ELECTRONIC DISPLAY AND CONTROL SYSTEM

[76] Inventor: Joseph N. Boucher, 6826 Nowadaha Blvd., Orlando, Fla. 32808

[21] Appl. No.: 915,523

[22] Filed: Jun. 14, 1979

[51] Int. Cl.[2] ..... A63F 7/16

[52] U.S. Cl. ..... 273/110; 273/118 D

[58] Field of Search ..... 273/110, 118 D, 113, 273/115, 116, 1 E, 250

[56] References Cited

U.S. PATENT DOCUMENTS

| | | | |
|---|---|---|---|
| 3,399,896 | 9/1968 | Burnside | 273/110 X |
| 3,539,188 | 11/1970 | Salverda | 273/110 |
| 3,675,927 | 7/1972 | Gottlieb et al. | 273/110 X |
| 3,751,038 | 8/1973 | O'Keefe | 273/110 |
| 3,787,055 | 1/1974 | Kraemer | 273/110 |
| 3,810,615 | 5/1974 | Miller | 273/1 E |

*Primary Examiner*—George J. Marlo

*Attorney, Agent, or Firm*—Duckworth, Hobby & Allen

[57] ABSTRACT

A game including a tiltable table, a control stick and table deflection linkage coupled between the control stick and the table for permitting a player to guide the movement of a ball over the surface of the table. The table is supported about its center of gravity by a pivot mount. The table deflection linkage is connected to the periphery of the table to permit the player to controllably tilt the table to guide the ball to a plurality of targets while avoiding a plurality of hazards. The targets may simulate "planets" and the hazards may be holes, or "black holes". A centrally located target is the "sun", and it is surrounded by other targets. All the targets may be illuminated, and circuitry is provided so that the illumination of the central "sun" target is altered only after the ball contacts the targets surrounding the "sun" target. An electronic circuit is provided to indicate the score to the player and to control various game functions.

9 Claims, 8 Drawing Figures

FIG. 1
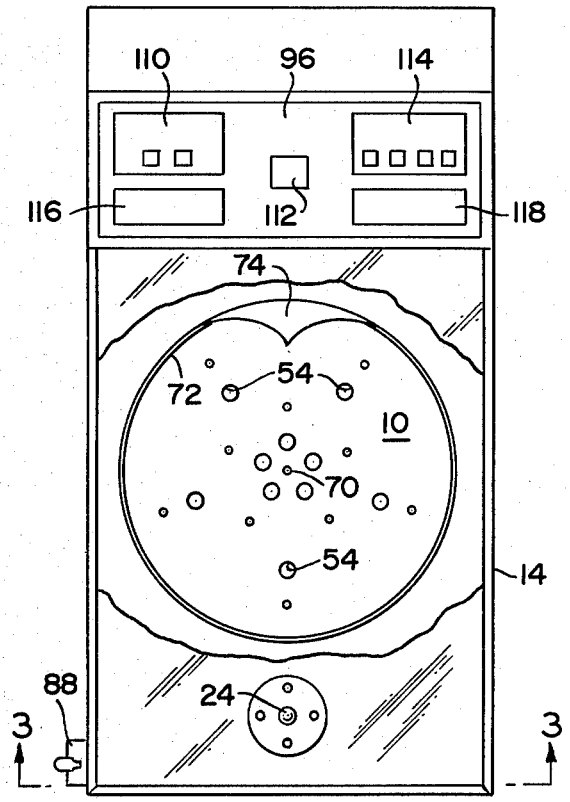
FIG. 2
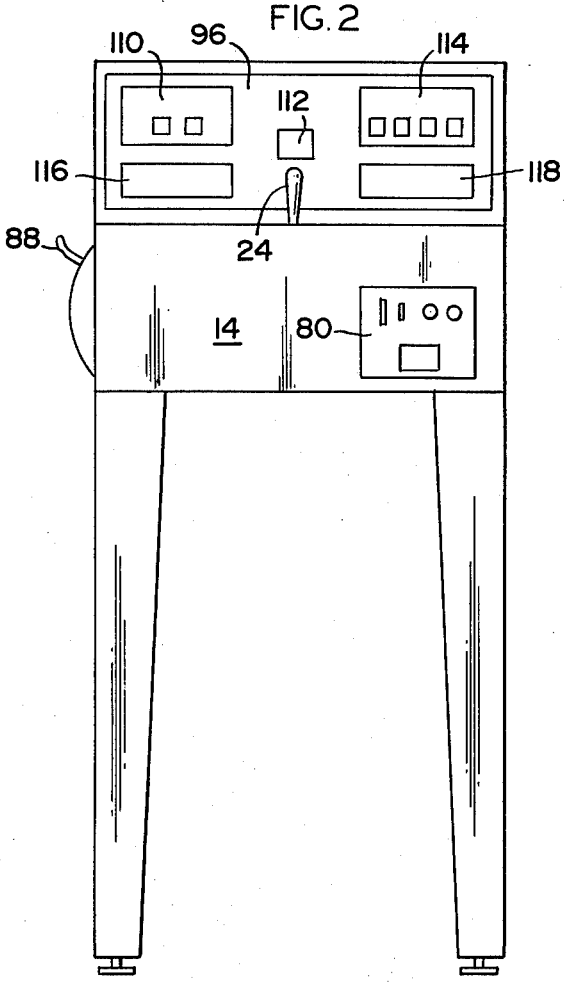
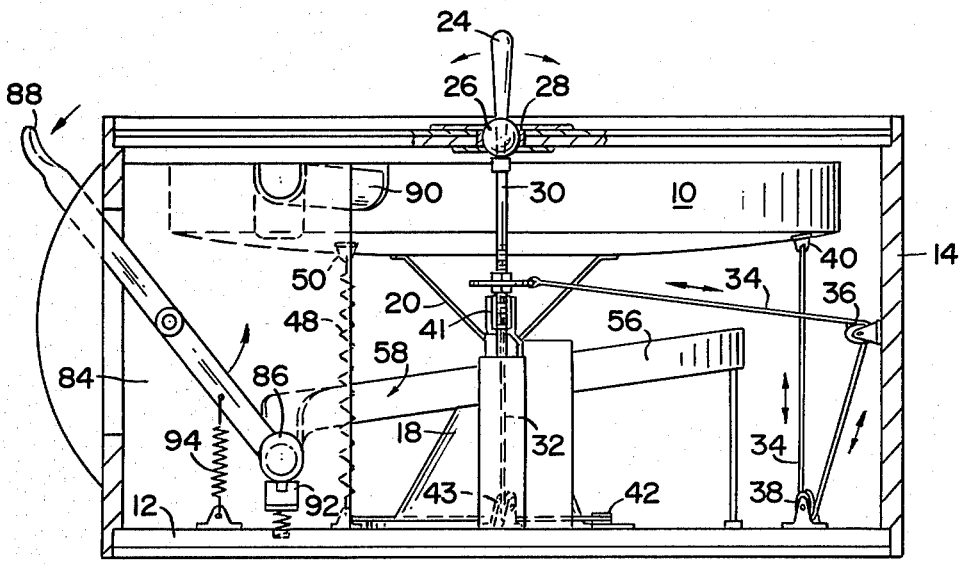
FIG. 3

PLAYER CONTROLLED TILTING GAME HAVING AN ELECTRONIC DISPLAY AND CONTROL SYSTEM

BACKGROUND OF THE INVENTION

1. Field of the Invention

The present invention relates to games and, more particularly, to games having a tiltable surface controllable by a player to displace a ball about the tiltable surface.

2. Description of the Prior Art

There are a variety of prior art games having tiltable surfaces for controlling the displacement of a ball.

In U.S. Pat. Nos. 3,384,374 (Boothe) and 3,751,038 (O'Keefe), games are disclosed which include a tiltable, gimble-mounted surface the deflection of which is controlled by a player displacing an externally accessible control stick. Each of these games discloses an intermediate, displaceable frame for permitting the gimbling suspension and two dimensional displacement of the tiltable playing surface of the game.

In U.S. Pat. No. 3,185,197 (Bryon) a game is disclosed which includes a gimble-mounted, tiltable playing surface controlled by two spaced apart control sticks.

Other games having less freely controllable tilting surfaces are disclosed in the following U.S. Pat. No. 2,791,428 (McDonald), U.S. Pat. No. 2,658,755 (Benak), U.S. Pat. No. 3,785,650 (Halliburton), and U.S. Pat. No. 3,934,881 (Golfarb).

Other games having a tiltable playing surface are disclosed in U.S. Pat. No. 4,030,555 (Boyce) and U.S. Pat. No. 3,680,864 (Peterson).

SUMMARY OF THE INVENTION

The present invention contemplates a game positioned within a cabinet having a base and including a ball freely movable by gravity. A table is pivotably supported about its center of gravity above the base of the cabinet. A plurality of targets and ball capturing means are positioned about the upper surface of the table. Tilting means are coupled to the periphery of the table to permit a player to guide the ball over the surface of the table to intercept the targets while avoiding the ball capturing means. Signalling means are coupled to each of the targets to indicate the passage of the ball over each target. Scoring means are coupled to the signalling means to convert the signals from the signalling means into a visually readable score. Control means coupled to signalling means and to the scoring means may be provided to require the player to direct the ball to the targets in a predetermined sequence to increment the scoring means.

An important aspect of the present invention is that mechanically complex and troublesome gimble-mounts are avoided by providing a single pivotable support member for the tiltable table at its center of gravity.

Another important aspect of the present invention is that an inexpensive electronic control and display system is provided to substantially increase the sophistication of the game in order to maintain player interest at a high level.

DESCRIPTION OF THE DRAWING

The invention is pointed out with particularity in the appended claims. However, further objects and advantages together with the operation of the invention may be better understood by reference to the following detailed description taken in conjunction with the following illustrations, wherein:

FIG. 1 is a view from above of the game of the present invention.

FIG. 2 is an end view of the game of the present invention.

FIG. 3 is a sectional view of the game illustrated in FIG. 3 taken along line 3—3.

DETAILED DESCRIPTION OF THE INVENTION

In order to better illustrate the advantages of the invention and its contributions to the art, the various mechanical features of the preferred embodiment will first be reviewed in detail. Thereafter, a description of the electronic control and display system will be set forth and the interrelationship between the mechanical and electrical features and the operation of the overall disclosed embodiment of the invention will be described in detail.

Figure 5:
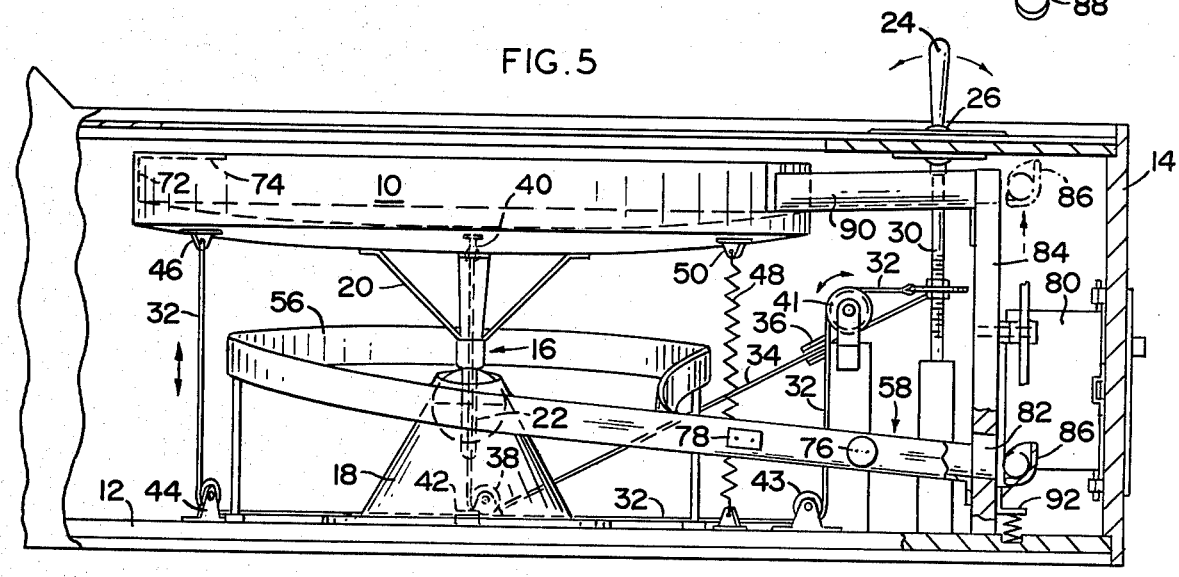
FIG. 5 is a partially cut away, side elevational view from the left-hand side of the game illustrated in FIG. 1.
Figure 6:
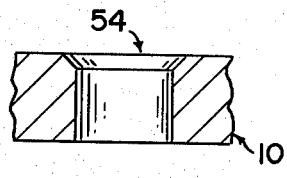
FIG. 6 is a sectional view of a ball hazard positioned within the table of the game of the present invention.

Referring now to FIGS. 1, 2 & 5, a table 10 is supported above the base 12 of a cabinet 14 by support means 16. Support means 16 includes a conical surface 18 and a downwardly extending mounting bracket 20 which is disposed about the center of gravity of table 10. Mounting bracket 20 also includes a downwardly extending shaft 22 which is disposed through an aperture in the upper surface of cone 18 to provide the desired freely pivoting motion of the table with respect to the rigidly mounted base 18.

A control stick 24 is provided to enable a player to controllably displace table 10 to a limited degree about two perpendicularly related axes. A centrally located portion 26 of control stick 24 is pivotably mounted in a bearing surface 28. The lower portion 30 of the control stick extends below bearing surface 28 and is coupled to a pair of control cables 32 and 34.

Figure 4:
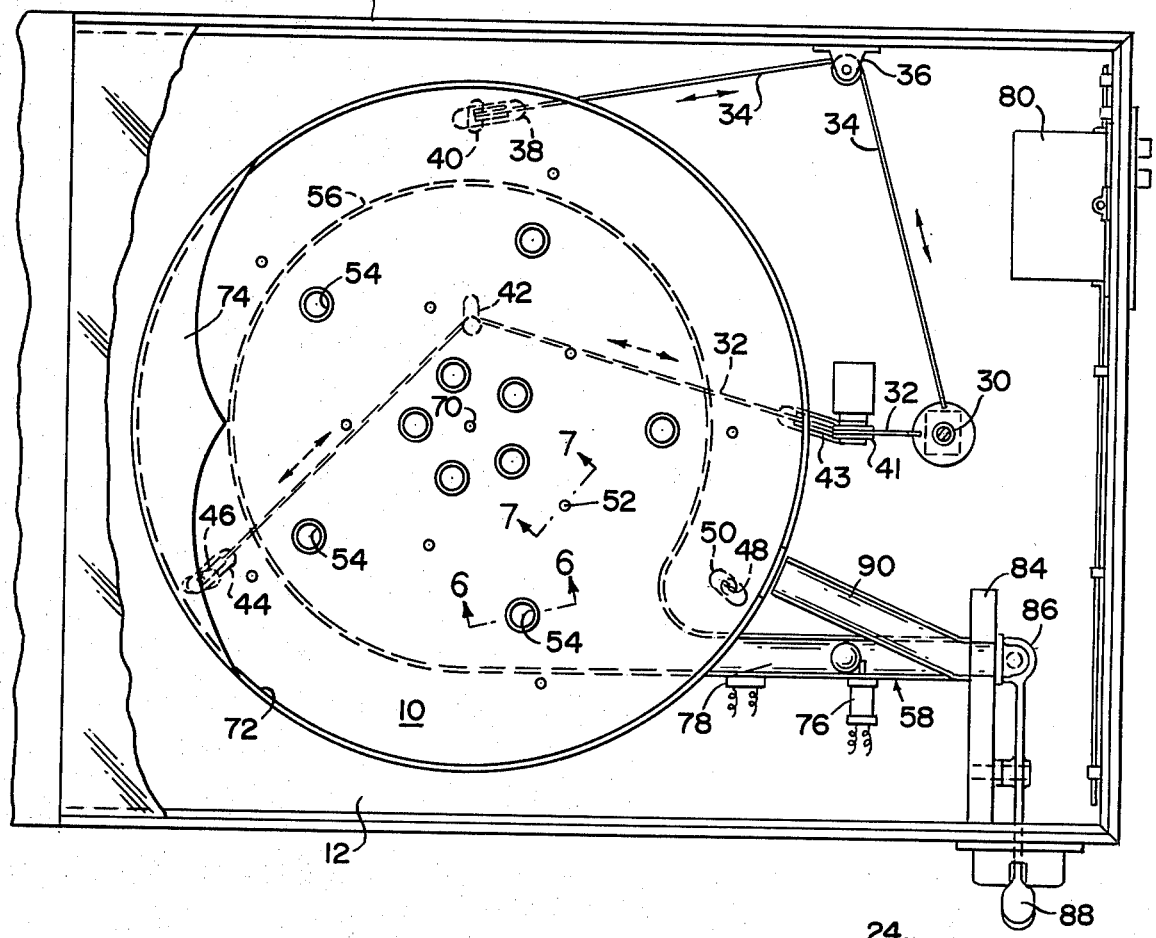
FIG. 4 is an enlarged, fragmentary sectional view from above of the game illustrated in FIG. 1.

Referring now to FIGS. 3,4 & 5, control cable 34 passes through pulleys 36 and 38 and is then securely attached to a bracket 40 on the lower peripheral surface of table 10. In a similar manner, control cable 32 passes through pulleys 41, 42, 43 & 44 and is coupled to a bracket 46 at a second point on the periphery of the lower surface of table 10. A biasing means or spring 48 is coupled between base 12 and the outer peripherial surface of table 10 by bracket 50 at a third point. Brackets 40, 46 & 50 are spaced at equal intervals around the circumference of table 10.

The surface of table 10 includes a plurality of targets or "planets", such as target 52, and a plurality of holes or "black holes", such as hole 54. Hole 54 has a diameter greater than the ball diameter and extends completely through the surface of table 10 and serves as a ball hazard or ball capturing means. Holes 54 are provided for the purpose of removing a ball from the surface of table 10. After a ball has dropped through one of the holes 54, it falls onto an inclined catch tray 56 which returns it to a ball dispensing area 58.

Figure 7:
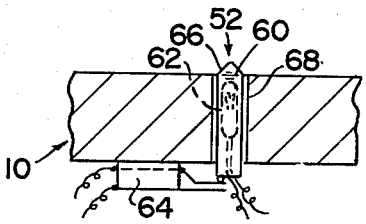
FIG. 7 is an enlarged sectional view of a target of the game of the present invention.

Referring now to FIGS. 4 & 7, each of the targets 52 includes a transparent or translucent housing 60 which includes a source of illumination such as an electric light bulb 62. When the play of the game is initiated, all of the targets 52 will be illuminated. Each target includes ball passage detecting means consisting of a spring biased single pole single throw switch 64, a slight protrusion 66 of housing 60 above the upper surface of table 10, and a shaft 68 in table 10 which permits housing 60 to be freely displaced downwardly into the surface of table 10 when a ball passes over protrusion 66. This downward displacement of housing 60 causes the contacts of switch 64 to be closed and actuates electronic circuitry which causes light 62 to be extinguished.

In the preferred embodiment of the invention, a centrally located target or "sun" 70 is provided specialized characteristics by the electronic circuitry of the game. As a ball rolls over each of the targets 52, switch 64 will be actuated and light 62 of the target will be extinguished. Causing a ball to pass over the "sun" or master target 70 after each of the other targets 52 have been actuated and their lights extinguished, will cause all of the targets to be re-illuminated so that a player can obtain an increased score as he continues to play the game. The electronic circuitry of the game is designed in such a manner that causing the ball to pass over the master target 70 prior to the time when the lights in each of the other targets is extinguished will have no effect on the illumination of the other targets or on the player's score. The electronic circuitry of the game is designed so that actuation of switch 64 associated with target 70 will have no effect on the illumination of target 70 itself.

Circumferentially extending lip 72 surrounds table 10 to prevent a ball from falling off the outer surface of the table. A ball deflector 74 (See FIG. 1) is provided at a single point around the periphery of table 10 to prevent a player from repeatedly circling a ball around the lip of table 10. Deflector 74 will deflect balls toward the center of table 10.

Referring now to FIGS. 3, 4, 5, & 6, after a ball falls through one of the holes 54 into catch tray 56 and rolls into the ball dispensing area 58, it is stopped by ball stop/ball release solenoid 76 which is controlled by the electronic circuitry of the game. As the ball rolls through ball dispensing area 58 it actuates ball count and solenoid actuator switch 78 which sends a signal to the electronic circuitry.

When a player wishes to commence playing a game, he inserts a coin into coin box 80 which causes the electronic circuitry to activate solenoid 76 which permits all of the plurality of balls utilized in a single game to roll beyond solenoid 76. The initial ball rolls through an aperture 82 in a support member 84 and continues into a pocket in ball elevator 86. The next succeeding ball remains in the vicinity of aperture 82 while the remaining balls are stacked up behind that second ball.

To commence the playing of the first ball the player depresses the handle 88 of ball elevator 86 which elevates the first ball to the top of support member 84 permitting it to roll down a ball delivery chute 90 and onto the upper surface of table 10. As soon as ball elevator 86 begins its upward travel, the spring biased gate 92 rotates upward to prevent the second and subsequent balls from being dispensed. A spring 94 biases ball elevator 86 back to its resting position which again deflects gate 92 downward, permitting the second ball to be displaced into the pocket of elevator 86. The player then controls the movement of the ball over the surface of table 10 be deflecting control stick 24.

Referring now to FIG. 2, the game also includes a display panel 96 which includes individual displays for indicating the following information: number of extra games played with a single coin (Ref. No. 110); number of balls played during a single game (Ref. No. 112); total score obtained during all game played with a single coin (Ref. No. 114); deactivation due to an excessive tilt of the game (Ref. No. 116); and termination of the game (Ref. No. 118). Each of these indicators is located on display panel 96 and is actuated and controlled by the electronic circuitry of the game which will now be described in detail with reference to FIG. 8.

In this schematic diagram the symbol D will be used to indicate a semiconductor diode; the symbol C will be used to represent a capacitor, the symbol Q will be used to indicate a silicon controlled rectifier. Other devices such as lights, switches and resistors will be designated by common electronic schematic symbols well known to those skilled in the art.

When a coin is deposited in coin box 80, a coin switch is closed temporarily which momentarily turns on Q1. The resulting positive going electrical pulse passes through blocking diode D1 to accomplish a number of functions. Game logic circuitry resets the game score counter and the extra game counter. The same positive pulse also passes through diodes $D_X$ to turn on all $Q_X$ and light up all the planets or targets 52. This pulse additionally turns on Q2 which energizes the ball stop solenoid 76 which releases the trapped balls from the area immediately behind solenoid 76. All of the balls then are repositioned into the ball dispensing area adjacent to ball elevator 86. This postive pulse also momentarily turns on Q3 which sends a negative pulse to Q4 which extinguishes the tilt light if it happens to be illuminated and closes the contacts of tilt relay 98 which applies the minus 2 volt bias voltage to one of the contacts of each of the target or planet switches 64. The negative voltage pulse produced by the momentary turn on of Q3 also activates Q5 to extinguish the game termination or game over light.

The game has now been totally reset and the player may commence play. The player dispenses the first ball onto the playing surface of table 10 by deflecting the handle of ball elevator 86. The object of the game is to attempt to destroy all of the planets (targets 52) by causing the spaceship (ball) to pass over to the protrusions 66 of the target housing 60 in order to actuate switch 64 which is coupled to the electronic circuit of the game. A related object of the game is to avoid losing balls through the holes 54 in the upper surface of table 10. When the lights in all of the targets 52 have been extinguished, they can be reilluminated by striking the master target 70. Causing the ball to pass over a target which has previously had its light extinguished will produce no result. In a similar manner causing the ball to pass over the master target 70 without previously having extinguished the lights in all other targets will produce no effect.

When switch 64 of a target is closed, a number of events occur in the electronic circuitry. The circuitry shown within the box 100 indicated by a series of dotted lines is duplicated for each target on the face of table 10.

When a ball causes the contacts of switch 64 associated with a particular target to close, the minus two volt bias voltage is coupled to the gate of $Q_x$ which causes planet light 62 to be extinguished. A positive going logic pulse is coupled through capacitor $C_x$ to the score counter of the game to increment the score by the number of points associated with one of the targets. This same positive going pulse passes through capacitor $C_y$ which momentarily activates Q8 causing capacitor C10 to be charged to a predetermined level. Charging of the RC timing circuit formed by the resistor and the capacitor C10 sounds a bell 102 and illuminates a light 104 to visually and aurally indicate that a score has been made. This same series of events occurs when the ball passes over any one of the targets 52.

As the ball passes over the final remaining illuminated target 52, closing the contacts of switch 64 in this final target biases Q7 to an on state which activates Q9. With the various elements of the electronic circuit in this particular state, causing the ball to pass over master target 70 turns off Q9 and sends a positive voltage pulse to the score counter. In the preferred embodiment of the game, a substantially higher point score is added to the total score when the ball passes over the master target 70 than is the case for other targets. If the total game score reaches one thousand points or some other predetermined amount while a single game is continuing, a positive voltage is sent to turn on Q13 to enable the extra game switch on the front of the cabinet and the logic displays and extra game lights on display panel 96. Q11 is also turned on in conjunction with the extra game light 110 causing light 104 to illuminate and bell 102 to sound.

When the first ball passes through a hole 54 and rolls down catch tray 56 past switch 78, the closure of switch 78 turns off Q2 and de-energizes ball stop solenoid 76. De-energizing solenoid 76 causes its shaft to extend outward into the ball dispensing area 58 which prevents any balls from being replayed. Each time ball stop switch 78 is actuated a negative voltage pulse is transmitted to Q12 which momentarily shuts off and sends a positive voltage pulse to the ball counter logic. The number of balls played during a game is thus indicated on the face of display panel 96. When the fifth ball trips ball stop switch 78, the logic circuitry sends a voltage pulse to Q5 which illuminates the game over light 118 on display panel 96.

Figure 8:
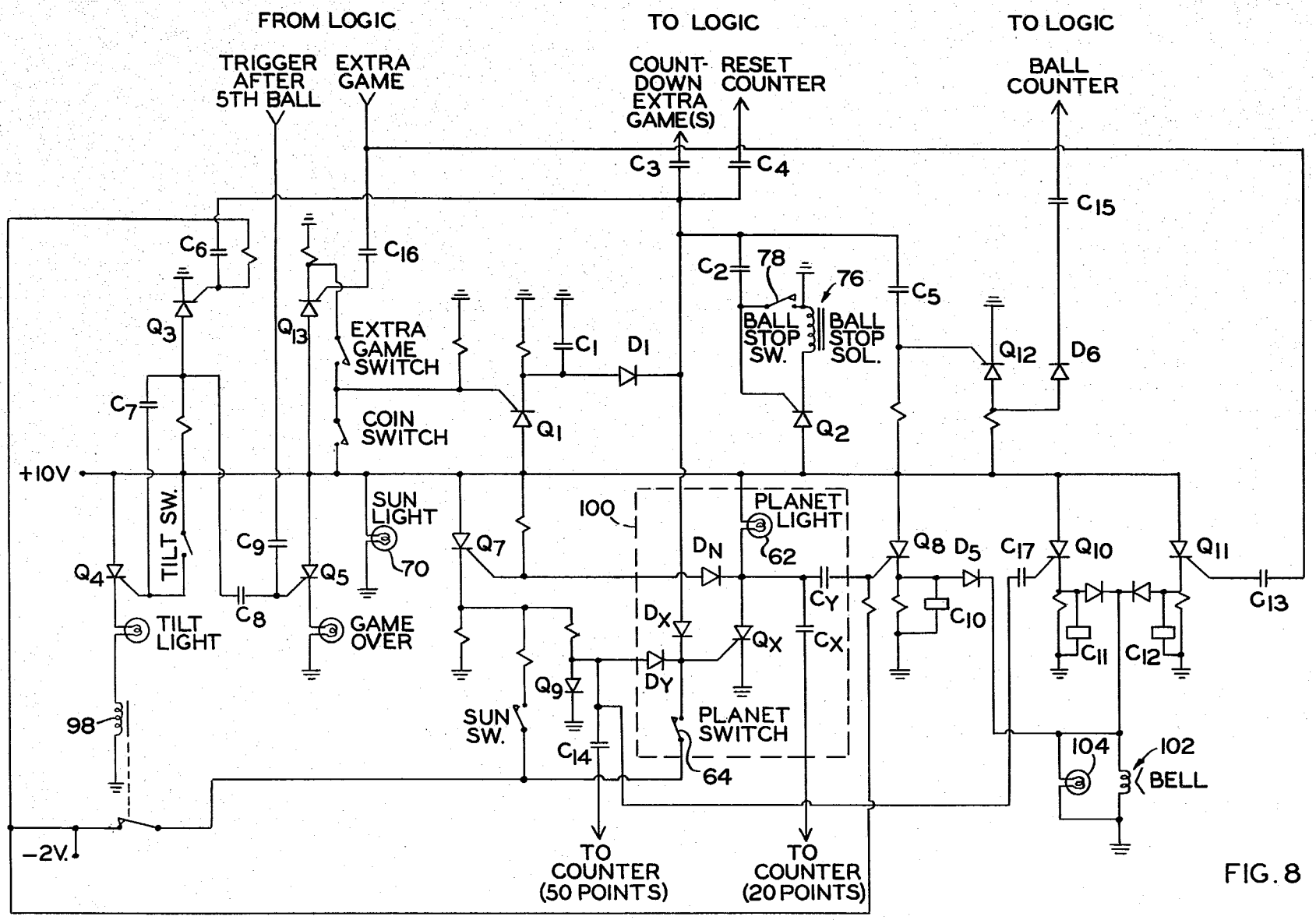
FIG. 8 is an electrical schematic diagram of the electrical circuitry of the game of the present invention.

All of the digital numerical displays on display panel 96 are of the LED type. The logic circuitry used in connection with the electronic circuitry shown in FIG. 8 is of a type readily commerically available and well known to those skilled in the art.

If an extra game is displayed on display panel 96, a player can commence playing that extra game by depressing a manual extra game button (not shown) which has the same effect as was caused by a momentary closure of the coin switch.

It will be apparent to those skilled in the art that the disclosed electronic game may be modified in numerous ways and may assume embodiments other than the preferred form specifically set out and described above. Accordingly, it is intended by the appended claims to cover all such modifications of the invention which fall within the true spirt and scope of the invention.

I claim:

1. Game apparatus comprising:

(a) a cabinet;

(b) a tiltable table supported by said cabinet;

(c) at least one ball on said table surface and freely movable by gravity;

(d) a first target on said table surface;

(e) a plurality of second targets on said table surface surrounding said first target;

(f) plural ball entrapments encircling said first target;

(g) means for illuminating all of said targets; and (h) circuit means coupled with said illuminating means for altering the illumination of said first target only after contact with all of said second targets by said ball.

2. The game of claim 1 wherein said tiltable table further includes spring means coupled to the periphery of said table for biasing said table to a neutral position.

3. The game of claim 2 wherein said tiltable table is capable of tilting said table about two perpendicularly related axes.

4. The game of claim 3 wherein said tiltable table further includes a control stick for enabling the player to tilt said table about two perpendicularly related axes.

5. The game of claim 1 wherein said table includes a circumferential lip extending upward from the surface thereof for containing the ball within the surface of the table.

6. The game of claim 5 wherein said table is circular in shape.

7. Game apparatus as recited in claim 1 further comprising means for recycling said circuit means following capture of a predetermined number of balls by said ball entrapments whereby all of said second targets must again be contacted by a next ball before an alteration in the illumination of said first target can take place.

8. Game apparatus as recited in claim 1 and wherein said circuit means further comprises means for altering the illumination of all of said second targets following contact with said first target by a ball, and after contact with all of said second targets by a predetermined number of balls.

9. The game of claim 1 wherein said tiltable table further includes spring means coupled to the periphery of said table for biasing said table to a neutral position.

* * * * *